US005588893A

United States Patent [19]

Kaftanov et al.

[11] Patent Number: 5,588,893

[45] Date of Patent: Dec. 31, 1996

[54] FIELD EMISSION CATHODE AND METHODS IN THE PRODUCTION THEREOF

[75] Inventors: V. S. Kaftanov; A. L. Suvorov; E. P. Sheshin, all of Moscow, Russian Federation

[73] Assignee: Kentucky Research and Investment Company Limited, Tortola, Virgin Islands (Br.)

[21] Appl. No.: 467,825

[22] Filed: Jun. 6, 1995

[51] Int. Cl.[6] ..... H01J 9/02

[52] U.S. Cl. ..... 445/6; 445/50

[58] Field of Search ..... 445/6, 24, 50

[56] References Cited

U.S. PATENT DOCUMENTS

| | | | |
|---|---|---|---|
| 2,817,002 | 12/1957 | Dyke et al. | 445/6 |
| 3,921,022 | 11/1975 | Levine | 445/50 X |
| 4,143,292 | 3/1979 | Hosoki et al. | 445/50 X |
| 4,272,699 | 6/1981 | Faubel et al. | 313/360 |
| 4,728,851 | 3/1988 | Lambe | 313/309 |
| 5,089,292 | 2/1992 | MaCaulay et al. | 313/336 X |
| 5,209,687 | 5/1993 | Konishi | 445/6 |
| 5,211,707 | 5/1993 | Ditchek et al. | 445/50 X |

*Primary Examiner*—Kenneth J. Ramsey

*Attorney, Agent, or Firm*—Jacobson, Price, Holman & Stern, PLLC

[57] ABSTRACT

An improved field emission cathode and methods for fabricating such an cathode are disclosed. In the methods of the invention, the field emission cathode is made from at least one body containing a first substance. The method steps include a preparation of irregularities in an emitting surface of the body, adding to the emitting surface of the body ions of a second substance with a low work function, and modifying the emitting surface by inducing field emission in applying a variable electric field to the body and increasing the field strength in steps.

7 Claims, 1 Drawing Sheet

FIELD EMISSION CATHODE AND METHODS IN THE PRODUCTION THEREOF

FIELD OF THE INVENTION

The present invention relates to a field emission cathode, specifically for illuminating devices, and to methods in the production of such a field emission cathode.

BACKGROUND OF THE INVENTION

In order for field emission illuminating devices to become useful, there is a need for a field emission cathode with a higher efficiency than known cathodes. Once a field emission cathode is achieved with a low work function, high durability, non-polluting composition and low production cost, it will be possible to replace a great variety of light sources with light sources including a field emission means in combination with a fluorescent surface for emission of visible light.

For example, great efforts are made today for reducing problems with commonly used fluorescent tubes, which require complicated external electrical devices and contain material with negative environmental effects. In present fluorescent tubes, gas discharge is employed for emitting radiation onto a fluorescent material that emits visible light in turn. A new type of emission means is desired for eliminating drawbacks of present fluorescent tubes.

PRIOR ART

U.S. Pat. No. 4,728,851 discloses a field emission cathode in an emitting device with a memory function, consisting of one carbon fibre with a diameter in the order of two micrometers with an emitting end sharpened by corona discharge to a diameter of approximately 0.2 micrometers.

U.S. Pat. No. 4,272,699 discloses a field emission cathode in an electron impact ion source device consisting of a bundle of carbon fibres with diameters in the order of two to ten micrometers with emitting ends, which are cut off and not sharpened by any refinishing operation.

The above-mentioned documents are incorporated by reference.

SUMMARY OF THE INVENTION

One main object of the invention is to provide a method in the production of a field emission cathode, wherein the cathode has a low work function. Another main object is to provide a method in the production of a field emission cathode, wherein the cathode is provided with a surface geometry that facilitates the achievement of local high electric field strengths for electron field emission. Another object is to provide a method in the production of a field emission cathode, wherein the cathode has a high mechanical and electrical durability. Another object is to provide a method in the production of a field emission cathode, wherein negative environmental effects of an illuminating device including the cathode are minimized. Another object is to provide a method in the production of a field emission cathode, wherein the cathode has an advantageous geometrical configuration. Another object is to provide a method in the production of a field emission cathode, wherein the cathode gives a very short switching time in the electron emission.

A further object of the invention is to provide a field emission cathode for electron field emission with a low electron work function in combination with a surface geometry adapted for high intensity local electric fields. Yet further objects of a field emission cathode of the invention are to attain a field emission cathode with an emitting surface having irregular topography facilitating electron field emission, a high mechanical durability, a high electrical durability of cathode as well as a long life in use, a high emission of energy per unit area of cathode, a very short switching time in the electron emission, and minimized negative environmental effects of an illuminating device including the cathode, respectively.

A further object of the invention is to improve an illuminating device, the operating principles of which are known per se, by employing at least one field emission cathode with features set fourth in this disclosure.

The above objects are attained by the features set forth in the appended claims.

In a general method of the invention, a field emission cathode constituted by at least one body, preferably, purified to contain essentially a first substance and, preferably, normalized in its internal and surface structure, is treated in the following steps: preparing the body or bodies by mechanical, erosion, and/or irradiation treatment so as to provide it with at least one emitting surface having irregularities facilitating electron field emission; adding to the emitting surface a second substance with a lower work function than that of the first substance, in order to lower the electrical field strength required to induce electron field emission from the emitting surface; modifying the emitting surface by applying to the body a variable electric field, in order to induce electron field emission from the emitting surface, and increasing the field intensity according to a predetermined scheme, in order to preserve the irregularities of the emitting surface, to such an extent that full operating voltage may then be applied momentarily without any substantial deterioration of the field emitting properties of the cathode.

One way of arriving at a suitable initial material for the cathode would be to anneal the body or the initial material, in order to remove therefrom other substances than the first substance and/or to normalize its structure. The term normalization may be understood as reduction of the occurrence of amorphous structures of the body the initial material.

The body of the cathode may have any geometric configuration, including but not limited to a fibre, a layer, a cone shaped body, and a block. The term irregularities should not be understood as excluding non-smooth geometries formed in a regular pattern on the emitting surface.

The preparation step may more specifically be performed through mechanical grinding, electrical spark discharge, or ion bombardment. In the latter case the bombardment could be performed with the second substance, which would in one step combine the preparing and adding steps.

In the case of the bodies being a bundle of fibres, there will occur typically, in the step of adding the second substance ions (bombarding emitting ends with ions), a spreading or diverging of the emitting ends of the bundled fibre segments, said spreading being advantageous for a wider distribution of electrons in the field emission.

Preferably, the first substance of the cathodes is carbon or a substance with similar properties. The use of carbon is advantageous, e.g., due to its ability to develop irregularities when hit by ions in production and in normal use. The second substance (the implant) may be cesium or other suitable material with a low work function. It would be possible to manufacture or develop a suited electro-conductive body from either a solid, liquid or gaseous phase of the selected substance or through an external action on the body.

The irregularities remaining after the step of preparing the emitting ends by adding (doping), or bombarding (irradiating) with, ions are crucial to field emission properties of the cathode. The irregularities may consist of peaks or tips (microtips) of, e.g., cesium-doped carbon. The radius of curvature of the tips are preferably in the range of 5–100 nm. The step of modifying the emitting surface is a "burning-in" process, in which the irregularities are rounded off at the peaks by melting due to heat generation from electron field emission. If this process is performed carefully, only the sharpest points are rounded off, leaving irregularities that withstand momentary application of full operating voltage without melting.

Preferably, the variable voltage in the step of modifying is either applied in predetermined steps, according to a predetermined (continuous) curve, or with regulation in respect to a maximum voltage derivate with respect to time, so as to limit probability of local current density in tips (irregularities) of the ends exceeding a predetermined value (restricting or limiting points of melting). Excessive melting will result in a disadvantageous smoothing out of the surface. This smoothing will be more severe should the heat not be allowed to escape from the tips through raising the field emission current (field intensity) slowly or in a number of steps the first time. A possible criterion for the modifying step could be limiting the probability of local current density in irregularities of the tips exceeding a predetermined value.

Generally, the first substance of the cathode could contain a crystal or a grain structure or both. Moreover, it is possible for the irregularities to occur in the form of micro-pores or cavities with high concentration, where the first substance has a (micro-) grain structure. Alternatively, the cathode could be a flat plate structure, e.g., achieved through pyrography.

The steps of preparing, adding (for example by bombarding) and modifying, respectively, may be used independently or in a different in order to arrive at a field emission cathode with an improved function.

More than one of the cathodes may be combined on a substrate into a compound cathode suited for the geometry of a specific illuminating device.

Although the invention is directed to use in lamps, fluorescent tubes or other illuminating devices it could be applied in various technical fields where electron field emission is desired. For example, it would even possible to apply the invention using only one single tip (irregularity).

DESCRIPTION OF A PREFERRED EMBODIMENT

In a preferred method of the invention, the field emission cathode is made from a fibre material containing a first substance, the method comprising firstly the steps of combining a plurality of fibres of the fibre material; cutting, mechanically or by melting, bundles from the fibre material, each bundle consisting of a plurality of fibre segments of a predetermined length; and annealing the fibre segments in order to remove therefrom other substances than the first substance, and/or to normalize the structure of the first substance in the fibre segments. After the cutting and annealing, the fibre segments of the bundles each have an emitting end with inherent irregularities, the method comprising secondly the steps of adding to the emitting ends of the fibre segments ions of a second substance with a lower work function than that of the first substance, in order to lower the electrical field strength required to induce electron field emission from the emitting ends and to increase and improve irregularities in the emitting ends, in order to facilitate electron field emission; and modifying the emitting ends by applying a variable voltage to the fibre segments and increasing according to a predetermined scheme the variable voltage, during electron field emission from the emitting ends, in order to preserve the irregularities of the emitting ends, to such an extent that full operating voltage may then be applied momentarily without any substantial deterioration of the field emitting properties of the cathode.

Figure 1:
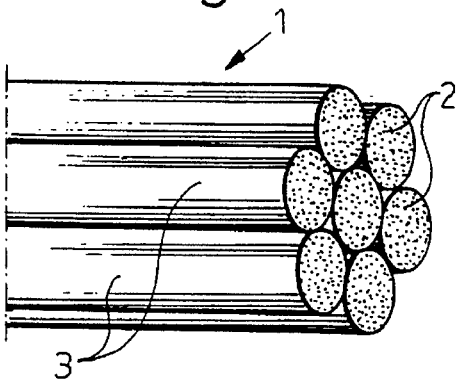
FIG. 1 shows for clarity, after a step of cutting fibres into segments and annealing the fibres, part of a bundle made of a plurality of the fibres to constitute one field emission cathode of the invention.
Figure 2:
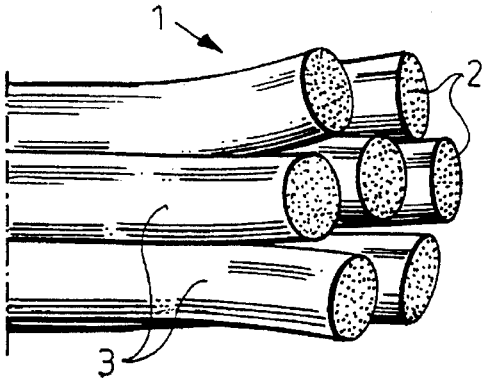
FIG. 2 shows the fibres of FIG. 1 after the step of adding ions by bombardment, in which a diverging of emitting ends of the fibre segments has occurred.

Starting from, e.g., commercially available polyacrylnitryl carbon fibres, or other suited material containing carbon, the cathodes are formed by cutting mechanically the carbon fibres. With reference to FIGS. 1 and 2, a field emission cathode of the invention consists of a bundle 1 of carbon fibres 3 with emitting ends 2. In a bundle 1 there may be in the order of a hundred fibres 3 or more. The diameter of the fibres 3 are in the range of seven micrometers. For clarity, a small number only of the carbon fibre segments is shown in FIGS. 1 and 2.

The first step in preparing the cut fibre bundles is annealing in an inert atmosphere at a temperature of 2 000°–3 000° C. during a few hours. This treatment purifies the carbon of the fibres and normalizes the grain and surface structure of the fibre, which is important especially near its emitting end.

Figure 3:
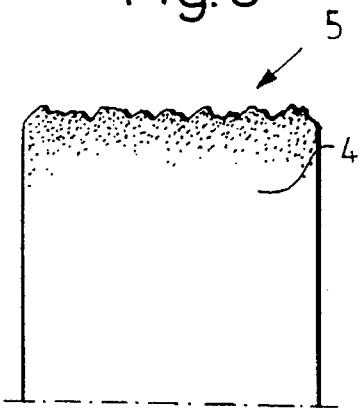
FIG. 3 shows schematically a possible "rough" profile of, generally, a surface to be prepared for emission in subsequent steps, and, specifically, an end surface of one fibre segment of FIG. 1.

FIG. 1 shows a part only of the bundle 1 of fibres 3 with the emitting ends 2 after the annealing. FIG. 3 shows a profile 5 of one fibre 4 after the annealing, the emitting end profile 5 having small irregularities.

Figure 4:
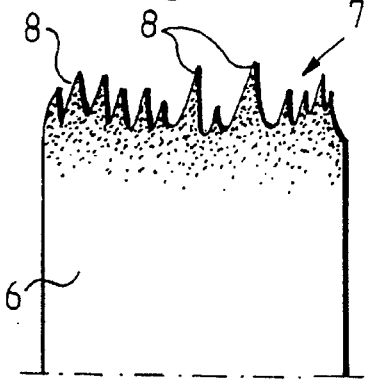
FIG. 4 shows schematically a possible "multi-pointed" profile of, generally, an emitting surface to be modified further for emission in a subsequent step, and, specifically, an end surface of one fibre segment of FIG. 2.

The second step is irradiation (bombardment) of the emitting ends with ions of cesium or lanthanum. The ions are saturated into the surface of the emitting ends, thereby lowering the electron work function of the emitting ends. Moreover, the irradiation impacts cause sharp irregularities in the emitting ends. Irregularities could alternatively be formed by irradiation with inert gas ions. FIG. 2 shows a part only of the bundle 1 of fibres 3 with the emitting ends 2 after the irradiation, wherein still another advantageous effect is achieved. The emitting ends 2 (the tips of the fibre segments) are slightly separated, which facilitates a wider distribution of emitted electrons. FIG. 4 shows a profile 7 of one fibre 6 after the irradiation, the emitting end profile 7 having high and sharp irregularities 8.

Figure 5:
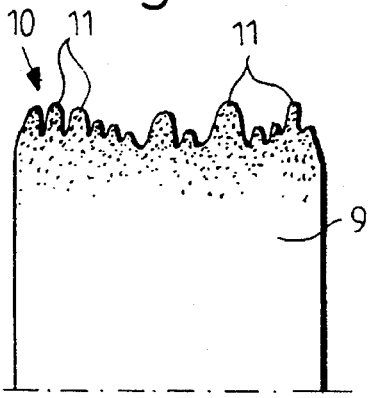
FIG. 5 shows schematically a possible "rounded off" profile of, generally, an emitting surface prepared and modified for emission, and, specifically, an end surface of one fibre segment of FIG. 2 after a step of modifying the ends of the fibre segments with a variable voltage.

The third step is modifying ("burning-in") of the irregularities of emitting ends. When an electric field strong enough is applied to the cathode, electron emission will occur from the emitting ends. As the electric field is increased, the emission will reach levels in the sharpest irregularities (peaks), causing them to melt locally. If the electric field strength is increased slowly, the melting will be restricted and a substantial portion of the irregularities be preserved, and so will the field emission properties of the emitting ends. Preferably, the electrical field is increased in five, possibly, equal steps from zero to full operating voltage, each step being approximately ten minutes. FIG. 5 shows a profile 10 of one fibre 9 after the modifying, the emitting end profile 10 having high, but slightly rounded irregularities 11.

Figure 6:
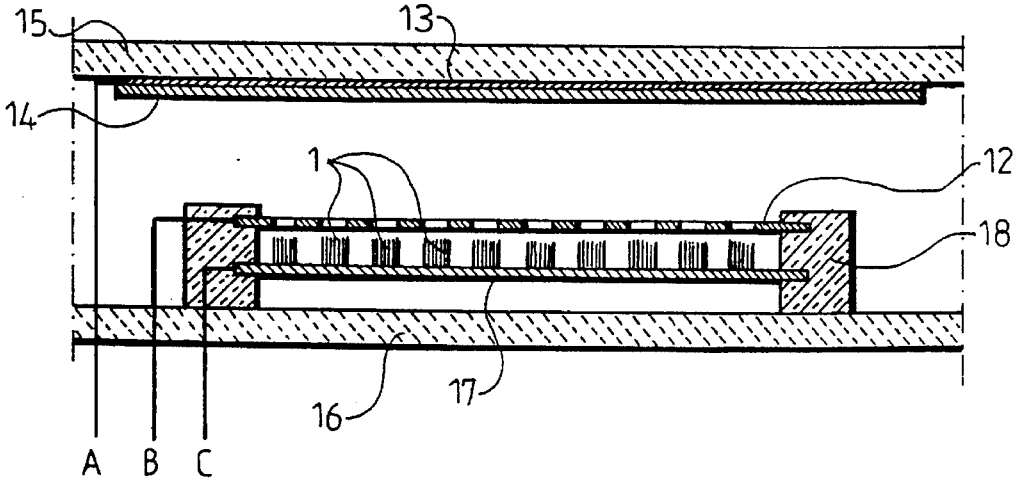
FIG. 6 shows field emission cathodes of the invention distributed in a matrix on a substrate in an illuminating device provided with a modulator grid electrode, an anode, and a fluorescent layer, operating inside an evacuated glass container.

FIG. 6 shows a light source with field emission cathodes applied in the form of bundles 1, preferably in a matrix, arranged on a conductive substrate 17. In the same plane as the matrix and in close proximity, in the order of tenths of millimetres, above the emitting ends of the bundles 1, there is provided a modulator electrode 12 with an aperture centred around each bundle. The substrate 17 and the modulator 12 rest on dielectric supports 18 inside an evacuated glass container with an upper boundary glass plate 15 and a lower boundary glass plate 16. Opposite the bundles 1 and the modulator, there is provided on the inside of the upper boundary 15 an anode 13 and a luminescent layer 14. The anode 13, the modulator 12, and the substrate 17, have electrical terminals A, B, C, respectively, for application of voltages leading electrons from the bundles 1, via the modulator apertures, to the luminescent layer 14 in connection with the anode 13. When electrons hit the luminescent layer 14, light is emitted escaping the transparent anode 13 and the glass container.

I claim:

1. A method in the production of a field emission cathode constituted by at least one body containing a first substance, said method comprising the steps of preparing said at least one body so as to provide it with at least one emitting surface (emitting surfaces) having irregularities facilitating electron field emission;

adding to said emitting surface a second substance with a lower work function than that of said first substance, in order to lower the electrical field strength required to induce electron field emission from said emitting surface; and modifying said emitting surface by applying to said at least one body a variable electric field, in order to induce electron field emission from said emitting surface, and increasing said variable electric field, in such a manner that the deterioration of said irregularities of said emitting surface is limited.

2. A method according to claim 1, wherein the step of preparing said at least one body comprises at least one of the following:

a mechanical treatment of said at least one body;

an erosion treatment of said at least one body;

an irradiation treatment of said at least one body.

3. A method according to claim 1, wherein the step of adding said second substance is integrated as a part of the step of preparing and is performed by irradiating said emitting surface with particles of said second substance, so as to improve the irregularities of said emitting surface facilitating electron field emission.

4. A method according to claim 1, wherein said variable electric field, in the step of modifying said emitting surface, is increased in steps with predetermined magnitudes and durations, from a low field strength to a field strength in the order of an operating voltage of said field emission cathode.

5. A method according to claim 1, wherein said at least one body is a fibre segment and said emitting surface is an end surface of said fibre segment.

6. A method according to claim 5, wherein said cathodes are formed as bundles from a plurality of said fibre segments, and wherein the step of adding said second substance is adapted for making said emitting ends of the bundled fibre segments diverge.

7. A method according to claims 1, wherein said field emission cathode is made from a material containing said first substance, said method comprising the step of annealing at an elevated temperature said material in order to obtain at least one of the following:

a removal from said material of other substances than said first substance;

normalization of internal structure of said material;

normalization of surface structure of said material.

* * * * *

UNITED STATES PATENT AND TRADEMARK OFFICE

CERTIFICATE OF CORRECTION

PATENT NO. : 5,588,893
DATED : December 31, 1996
INVENTOR(S) : V.S. Kaftanov, et al.

It is certified that error appears in the above-identified patent and that said Letters Patent is hereby corrected as shown below:

On the title page, item [73], Assignee, should read--LightLab AB, Stockholm, Sweden--.

Signed and Sealed this

Twenty-fifth Day of March, 1997

*Attest:*

Bruce Lehman

BRUCE LEHMAN

*Attesting Officer*

*Commissioner of Patents and Trademarks*